US005470055A

United States Patent [19]

Ritchie

[11] Patent Number: 5,470,055

[45] Date of Patent: Nov. 28, 1995

[54] BASEBALL AND GOLF HITTER'S TRAINING DEVICE

[76] Inventor: Gregory A. Ritchie, c/o M. Siegel, 974 East 18th St., Brooklyn, N.Y. 11230

[21] Appl. No.: 264,698

[22] Filed: Jun. 23, 1994

[51] Int. Cl.[6] ..... A63B 69/00

[52] U.S. Cl. ..... 273/26 R; 273/183.1

[58] Field of Search ..... 273/26 R, 183 B, 273/187 R, 188 R, 207

[56] References Cited

U.S. PATENT DOCUMENTS

| | | | |
|---|---|---|---|
| 3,414,268 | 12/1968 | Chase | 273/207 |
| 4,830,371 | 5/1989 | Lay | 273/26 R |
| 4,993,708 | 2/1991 | Prosser | 273/26 R |
| 5,100,134 | 11/1992 | Becker | 273/26 R |
| 5,125,663 | 6/1992 | Lurowist | 273/186 R |

*Primary Examiner*—Theatrice Brown

*Attorney, Agent, or Firm*—Davis Hoxie Faithfull & Hapgood

[57] ABSTRACT

A baseball hitter's training device is provided, comprising a base assembly, a height adjustable stanchion on the base assembly and a spring for flexing built into the stanchion. An adjustable seat is for steadying a hitter astride the stanchion, so as to help the hitter to perform a proper weight shift through the executing of a pre-swing stage and a swing stage for hitting a baseball, with a baseball bat. A golf hitter's training device is also provided, comprising a base assembly, a height adjustable stanchion on the base assembly and a spring for flexing built into the stanchion. A structure is on the base assembly for holding a golf ball thereto. An adjustable seat is for steadying a hitter astride the stanchion, so as to help the hitter to perform a proper weight shift through the executing of a pre-swing stage and a swing stage for hitting the golf ball on the holding structure with a golf club.

6 Claims, 2 Drawing Sheets

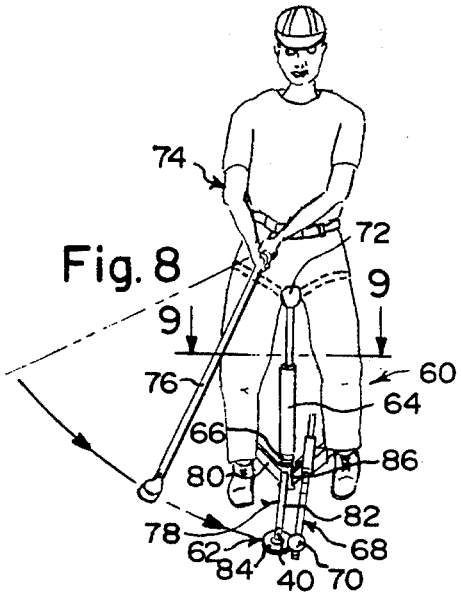
Fig. 8
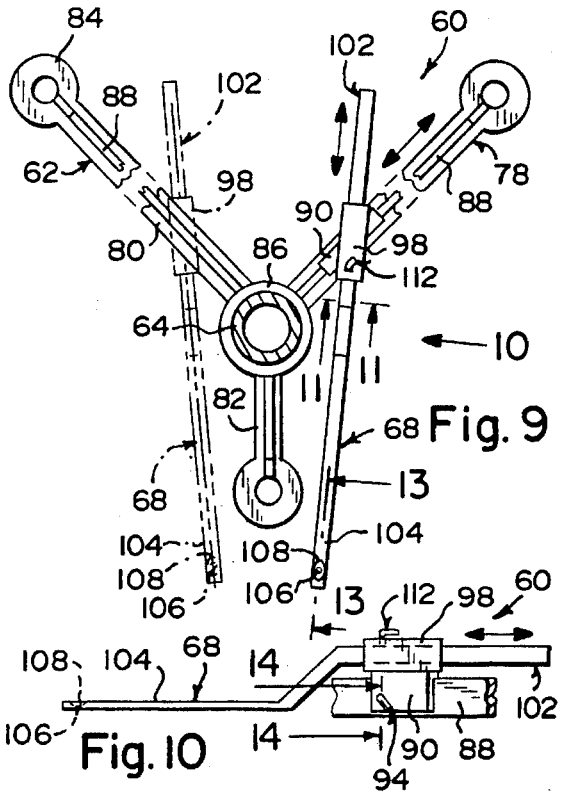
Fig. 9
Fig. 10
Fig. 12
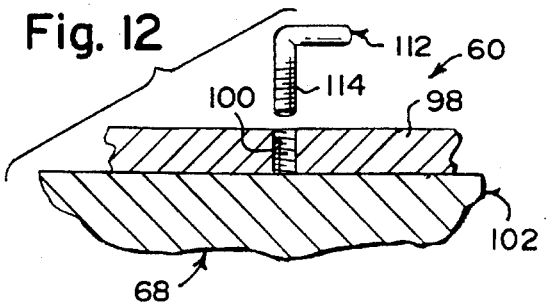
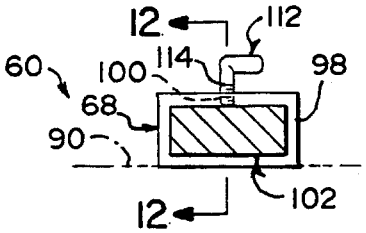
Fig. 11
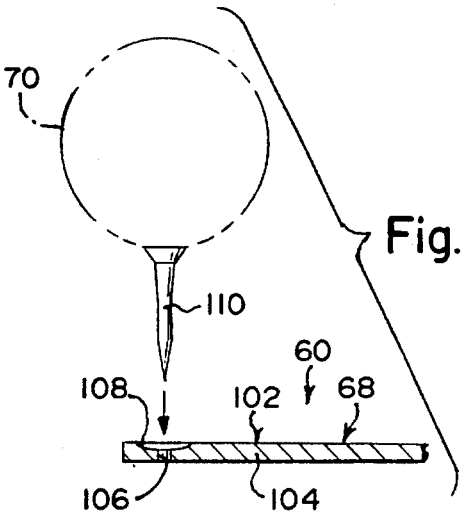
Fig. 13
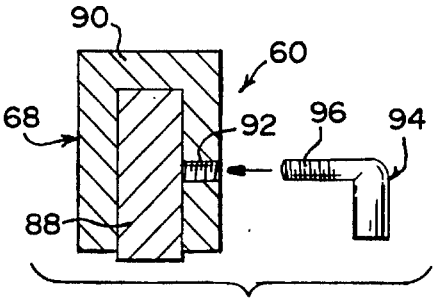
Fig. 14

BASEBALL AND GOLF HITTER'S TRAINING DEVICE

BACKGROUND OF THE INVENTION

The instant invention is the subject matter of Disclosure Document No.: 343,846, filed in the PTO on Dec. 1993, and it is respectfully requested that this document be retained beyond the two-year period so that it may be relied upon as evidence of conception of the invention during the prosecution phase of this application, should the need arise.

The instant invention relates generally to sporting instruction equipment and more specifically it relates to a baseball and golf hitter's training device.

Numerous sporting instruction equipment have been provided in prior art that are adapted to make players proficient with specialized instruction and practice to enhance their game performance. While these units may be suitable for the particular purpose to which they address, they would not be as suitable for the purposes of the present invention as heretofore described.

SUMMARY OF THE INVENTION

A primary object of the present invention is to provide a baseball and golf hitter's training device that will overcome the shortcomings of the prior art devices.

Another object is to provide a baseball and golf hitter's training device that will create a better balance to help a hitter to perform a proper weight shift through the executing of a pre-swing stage and a swing stage for hitting either a baseball or a golf ball as the case may be.

An additional object is to provide a baseball and golf hitter's training device that is adjustable to fit to the size of the hitter, so as to give comfort to the hitter.

A further object is to provide a baseball and golf hitter's training device that is simple and easy to use.

A still further object is to provide a baseball and golf hitter's training device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 8 is a front perspective view of a second embodiment of the instant invention in use by a golfer;

FIG. 9 is an enlarged cross sectional view taken on line 9—9 in FIG. 8;

FIG. 10 is a side elevational view with parts broken away taken in the direction of arrow 10 in FIG. 9;

FIG. 11 is an enlarged cross sectional view with parts broken away taken on line 11—11 in FIG. 9;

FIG. 12 is a still further enlarged cross sectional view with parts broken away taken on line 12—12 of FIG. 11;

FIG. 13 is an enlarged cross sectional view taken on line 13—13 in FIG. 9, showing how a golf ball may be mounted with or without a golf tee thereto; and FIG. 14 is an enlarged cross sectional view taken on line 14—14 in FIG. 10.

DETAILED DESCRIPTION OF THE PREFERRED EMBODIMENTS

Figure 1:
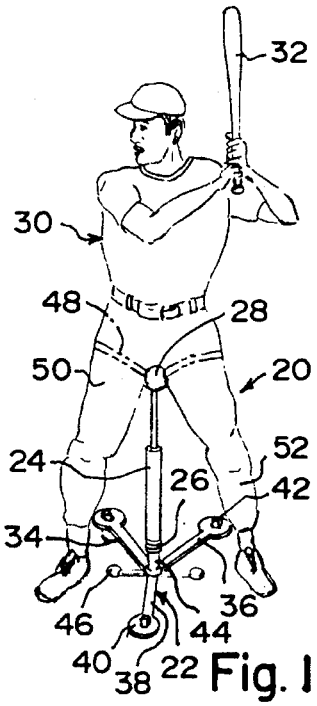
FIG. 1 is a front perspective view of a first embodiment of the instant invention in use by a baseball player.
Figure 2:
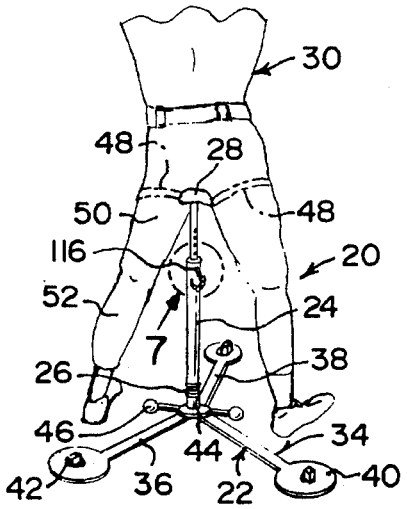
FIG. 2 is a rear perspective view.
Figure 4:
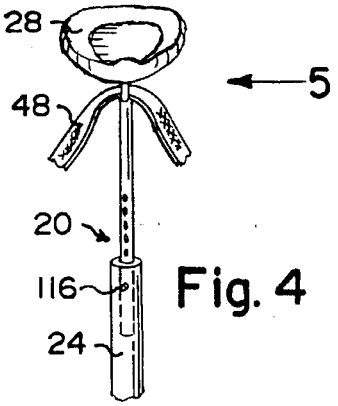
FIG. 4 is an enlarged front perspective view of an upper portion thereof, showing the seat structure.
Figure 5:
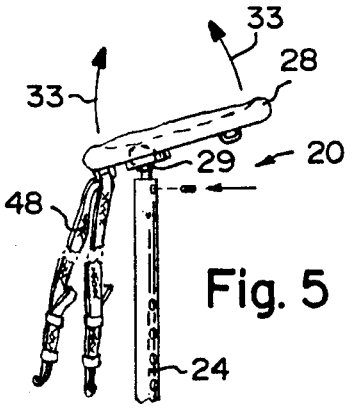
FIG. 5 is a side elevational view taken in the direction of arrow 5 in FIG. 4.
Figure 3:
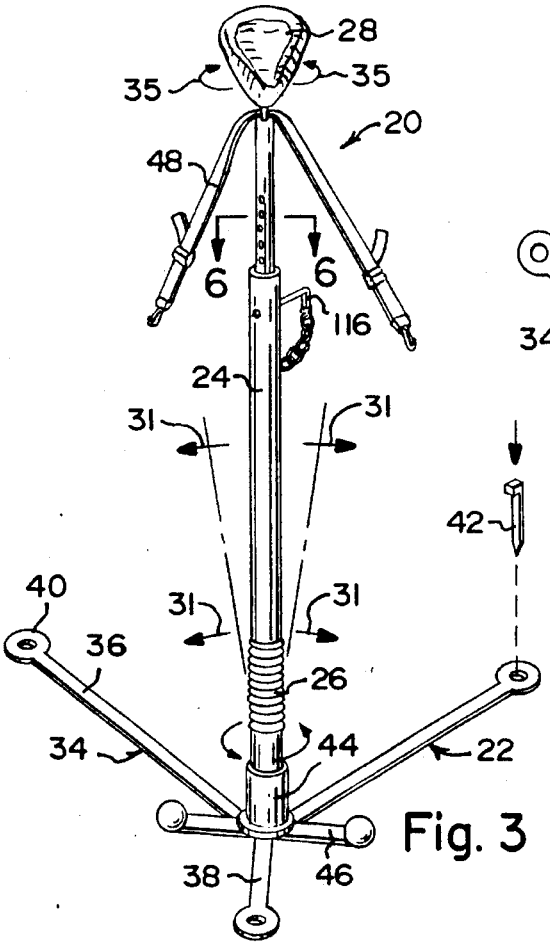
FIG. 3 is an enlarged front perspective view of the instant invention per se.
Figure 6:
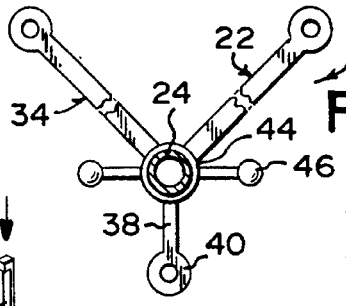
FIG. 6 is a cross sectional view taken on line 6-6 in FIG. 3.

Turning now descriptively to the drawings, in which similar reference characters denote similar elements throughout the several views, FIGS. 1 through 7 illustrate a baseball hitter's training device 20, comprising a base assembly 22. A height adjustable stanchion 24 is on the base assembly 22. A spring 26 for flexing is built into the stanchion 24, and permits the stanchion to tip about the spring as indicated by arrows 31. An adjustable seat 28 is for steadying a hitter 30 astride the stanchion 24, so as to help the hitter 30 to perform a proper weight shift through the executing of a pre-swing stage and a swing stage for hitting a baseball, with a baseball bat 32. The seat 28 is effectively secured with a ball joint 29 to the stanchion 24 which permits the seat to automatically adjust to the user's rotative movement indicated by arrows 33,35 but substantially forces the user maintain a proper stance.

The base assembly 22 includes a tri-foot radial configuration 34 having two long rearwardly extending feet 36 and a short forwardly extending foot 38. Each foot 36, 38 has an eyelet shaped end 40, to receive a spike 42 to hold the feet 36, 38 securely on the ground. A collar 44 extends upwardly from the center of the tri-foot radial configuration 34, to receive a bottom end of the stanchion 24. A visual rotation indicator 46 extends horizontally across, between the two long feet 36 and the short foot 38, so that the hitter 30 can visually judge the swing of the baseball bat 32.

An adjustable strap 48 can be coupled to the seat 28, for securement about the thighs 50 of the legs 52 of the hitter 30, to maintain the hitter 30 upon the seat 28.

FIGS. 8 to 14 show a golf hitter's training device 60, comprising a base assembly 62. A height adjustable stanchion 64 is on the base assembly 62. A spring 66 for flexing is built into the stanchion 64. A structure 68 is on the base assembly 62, for holding a golf ball 70 thereto. An adjustable seat 72 is for steadying a hitter 74 astride the stanchion 64, so as to help the hitter 74 to perform a proper weight shift through the executing of a pre-swing stage and a swing stage for hitting the golf ball 70 on the holding structure 68 with a golf club 76.

The base assembly 62 includes a tri-foot radial configuration 78, having two long rearwardly extending feet 80 and a short forwardly extending foot 82. Each foot 80, 82 has an eyelet shaped end 84 to receive a spike 42 to hold the feet 80, 82 securely on the ground. A collar 86 extends upwardly from the center of the tri-foot radial configuration 78, to receive a bottom end of the stanchion 64. Two upstanding rails 88 are also provided, with each affixed onto each long foot 80, so that the holding structure 68 can be adjustable and connected to either of the rails 88.

The holding structure 68 contains a channel 90 to ride upon either of the rails 88, for a right handed and a left handed hitter 74. The channel 90 has a side threaded hole 92. A first L-shaped locking screw 94 having a threaded shank 96 engages with the side threaded hole 92 in the channel 90, to retain the channel 90 in a stationary position on upon either of the rails 88. A sleeve 98 is angularly mounted onto the channel 90. The sleeve 98 has a top threaded hole 100. An adjustable slide bar 102 fits through the sleeve 98. The slide bar 102 has a downwardly bent front portion 104 with an aperture 106 and a top cup-shaped recess 108 above the aperture 106 in a forward end of the front portion 104, to receive a golf tee 110 and the gold ball 70. A second L-shaped locking screw 112 having a threaded shank 114 engages with the top threaded hole 100 in the sleeve 98, to retain the slide bar 102 in a stationary position within the sleeve 98.

OPERATION OF THE INVENTION

Figure 7:
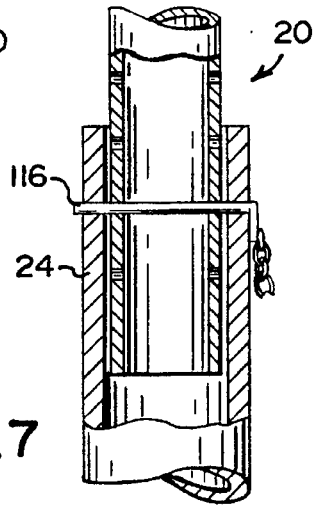
FIG. 7 is an enlarged elevational view partially in section as indicated by arrow 7 in FIG. 2.

To use the baseball hitter's embodiment of the training device 20, the hitter 30 places the base assembly 22 upon the ground. The spikes 42 are driven into the ground through the eyelet shaped ends 40. The stanchion 24 is adjusted to its proper height and retained by a pin 116, as best seen in FIG. 7, so that the hitter 30 can be astride upon the seat 28. The adjustable strap 48 can be secured to the thighs 50 of the legs 52 of the hitter 30, if so desired. This help the hitter improve his posturing when hitting the base ball.

To use the golf hitter's embodiment of the training device 60, the hitter 74 places the base assembly 62 upon the ground. The spikes 42 are driven into the ground through the eyelet shaped ends 84. The stanchion 64 is adjusted to its proper height and retained by the pin 116, so that the hitter 74 can be astride upon the seat 72, with the holding structure 68 having already been mounted to either the right side or left side of the base assembly 62 and appropriately adjusted. The golf tee 110 and the golf ball 70 is then placed through the aperture 106 and top cup-shaped recess 108 in the front portion 104 of the slide bar 102.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A ball hitter's training device comprising:

a) a base assembly;

b) a height adjustable stanchion having one of it's ends attached to said base assembly;

c) a spring relative to said attached intermediate the ends of said stanchion for permitting pivoting a portion of said stanchion base assembly;

d) an adjustable saddle suitable for a hitters; and e) a ball joint rotatively securing said adjustable seat to the other said stanchion permitting said adjustable seat to rotate while steadying a hitter astride said stanchion and sitting on said seat, so as to help the hitter to perform a proper weight shift through the executing of a pre-swing stage and a swing stage for hitting a base with a base bat.

2. A base hitter's training device as recited in claim 1, wherein said base assembly includes:

a) a tri-foot radial configuration having two long rearwardly extending feet and a short forwardly extending foot, with each said foot having an eyelet shaped end to receive a spike to hold said feet securely on the ground;

b) a collar extending upwardly from the center of said tri-foot radial configuration to receive a said one of said stanchion.

3. A ball hitter's training device as recited in claim 2, further including an adjustable strap coupled to said seat for securement about the thighs of the legs of the hitter, to maintain the hitter upon said seat.

4. A golf hitter's training device comprising:

a) a base assembly;

b) a height adjustable stanchion having one of its ends attached to said base assembly;

c) a spring attached intermediate the ends of said stanchion for permitting pivoting a portion of said stanchion relative to said base assembly;

d) means on said base assembly for holding a golf ball thereon;

e) an adjustable seat suitable for a hitter to comfortably sit on while swing a golf club; and f) a ball joint rotatively securing said adjustable seat to the other end of said stanchion permitting said adjustable seat to rotate while steadying a hitter astride said stanchion, so as to help the hitter to perform a proper weight shift through the executing of a pre-swing stage and a swing stage for hitting the golf ball on said holding means with a golf club.

5. A golf hitter's training device as recited in claim 4, wherein said base assembly includes:

a) a tri-foot radial configuration having two long rearwardly extending feet and a short forwardly extending foot, with each said foot having an eyelet shaped end to receive a spike to hold said feet securely on the ground;

b) a collar extending upwardly from the center of said tri-foot radial configuration to receive said one of said stanchion, each long foot further having a longitudinal rail portion extending substantially the entire length thereof; and elongated channel member for being interchangeably slidally received on either of said rail portions, and means to allow locking said channel member at a desired location on a said rail portion, said channel member having an elongated sleeve attached at substantially horizontal angle relative to the longitudinal axis of said rail portion;

an adjustable slide bar slidably extending through said sleeve, said slide bar extending forwardly of said seat and along a support surface; said slide bar having an aperture extending therethrough at the forward and thereof for vertically supporting a golf tee received therein; and, means for locking said slide bar in said sleeve - has been substituted therefor.

6. A baseball hitters training device comprising:

a) a base assembly;

b) a height adjustable stanchion having one of its ends attached to said base assembly;

c) a spring attached intermediate the ends of said stanchion for permitting pivoting of a portion of said stanchion relative to said base assembly;

d) an adjustable seat suitable for a hitter to comfortably sit on which swinging a bat; and e) a ball point rotatably securing said seat to the other end of said stanchion and permitting said seat to rotate while steadying a hitter astride said stanchion and sitting on said seat, so as to help the hitter to perform a proper weight shift through the execution of a pre-swing and a swing stage for hitting a baseball with a baseball bat.

* * * * *